US005601278A

United States Patent [19]

Graber

[11] Patent Number: 5,601,278

[45] Date of Patent: Feb. 11, 1997

[54] PICKET FENCE

[76] Inventor: Loren Graber, P.O. Box 42, 3446 US 6 E., Bremen, Ind. 46506

[21] Appl. No.: 630,204

[22] Filed: Apr. 10, 1996

Related U.S. Application Data

[63] Continuation-in-part of Ser. No. 373,543, Jan. 17, 1995, abandoned.

[51] Int. Cl.[6] ..... E04H 17/24

[52] U.S. Cl. ..... 256/66; 256/19

[58] Field of Search ..... 256/19, 66, 65, 256/59

[56] References Cited

U.S. PATENT DOCUMENTS

| | | | |
|---|---|---|---|
| 3,892,056 | 7/1975 | Mann | 256/19 X |
| 3,902,703 | 9/1975 | Bouye | 256/19 X |
| 3,955,801 | 5/1976 | Soriero, Jr. | 256/65 X |
| 4,007,919 | 2/1977 | Totten | 256/65 X |
| 5,255,897 | 10/1993 | Pepper | 256/66 X |

FOREIGN PATENT DOCUMENTS

| | | | |
|---|---|---|---|
| 127429 | 6/1919 | United Kingdom | 256/19 |

*Primary Examiner*—Anthony Knight
*Attorney, Agent, or Firm*—Baker & Daniels

[57] ABSTRACT

A picket fence includes a pair of substantial vertical posts, a top and bottom rail members supported by each of the posts, and pickets attached to the top and bottom rail members. The posts, rails and pickets are all made of the polyvinyl material. The pickets are attached to the rails by cleats engaging keyhole shaped slots in the pickets. In one embodiment of the invention, the keyhole shaped slots extend in opposite directions, so that the rails must be moved relative to the pickets in order to secure the pickets to the rails. Accordingly, the pickets cannot be removed from the rails without first removing the rails from the posts. In another embodiment of the invention, keyhole slots extend in the same direction, and a locking arm extends from the cleats into the narrower portion of the keyhole slot. Accordingly, in order to remove the picket from the rail, both the top and bottom portions of the picket must first be deflected slightly and the picket must then be forced downwardly. In each instance, it is extremely unlikely that the pickets can be removed accidentally, or by children playing around the fence.

18 Claims, 7 Drawing Sheets

PICKET FENCE

This application is a continuation-in-part of U.S. Ser. No. 08/373,543 filed Jan. 17, 1995, now abandoned.

This invention relates to a polyvinyl picket fence. Polyvinyl picket fences have many decorative and practical uses. These fences are made from polyvinyl extruded into tubular members. These tubular members may be posts used to support the fence, upper and lower rails extending between the posts and pickets attached to the upper and lower rails. Accordingly, a decorative, long lasting fence is provided which is sufficiently strong that animals can be retained yet is also long lasting and extremely durable. The polyvinyl used to make the fence is mixed with a pigment so that the final product never needs painting.

Most existing polyvinyl fences of the same general type disclosed herein require visible fasteners to fasten the pickets to the rails. Furthermore, the pickets can be detached from the rails by children playing near the fence. The present invention relates to a polyvinyl picket fence system in which the pickets are attached to the rails by fasteners that are concealed and that prevent the pickets from being removed from the rails unless the rails are first removed from the supporting posts. The fasteners include cleats on the rails that are received within keyhole slots in the pickets. In one embodiment, the keyhole slots include oppositely directed portions that embrace the cleats so that the cleats cannot be removed from the slots after the rails are installed on the posts. In the other embodiment of the invention, the cleats include a locking arm which locks in the narrow portion of the keyhole slot, thereby requiring that the top and bottom of the pickets be deflected before the picket can be removed. Accordingly, in both embodiments, it is extremely unlikely that children playing near the fence will be able to remove one or more of the pickets from the fence since the fasteners are located on the portions of the rails which engage corresponding portions of the pickets.

These and other features of the present invention will become apparent from the following description, with reference to the accompanying drawings, in which.

Figure 1:
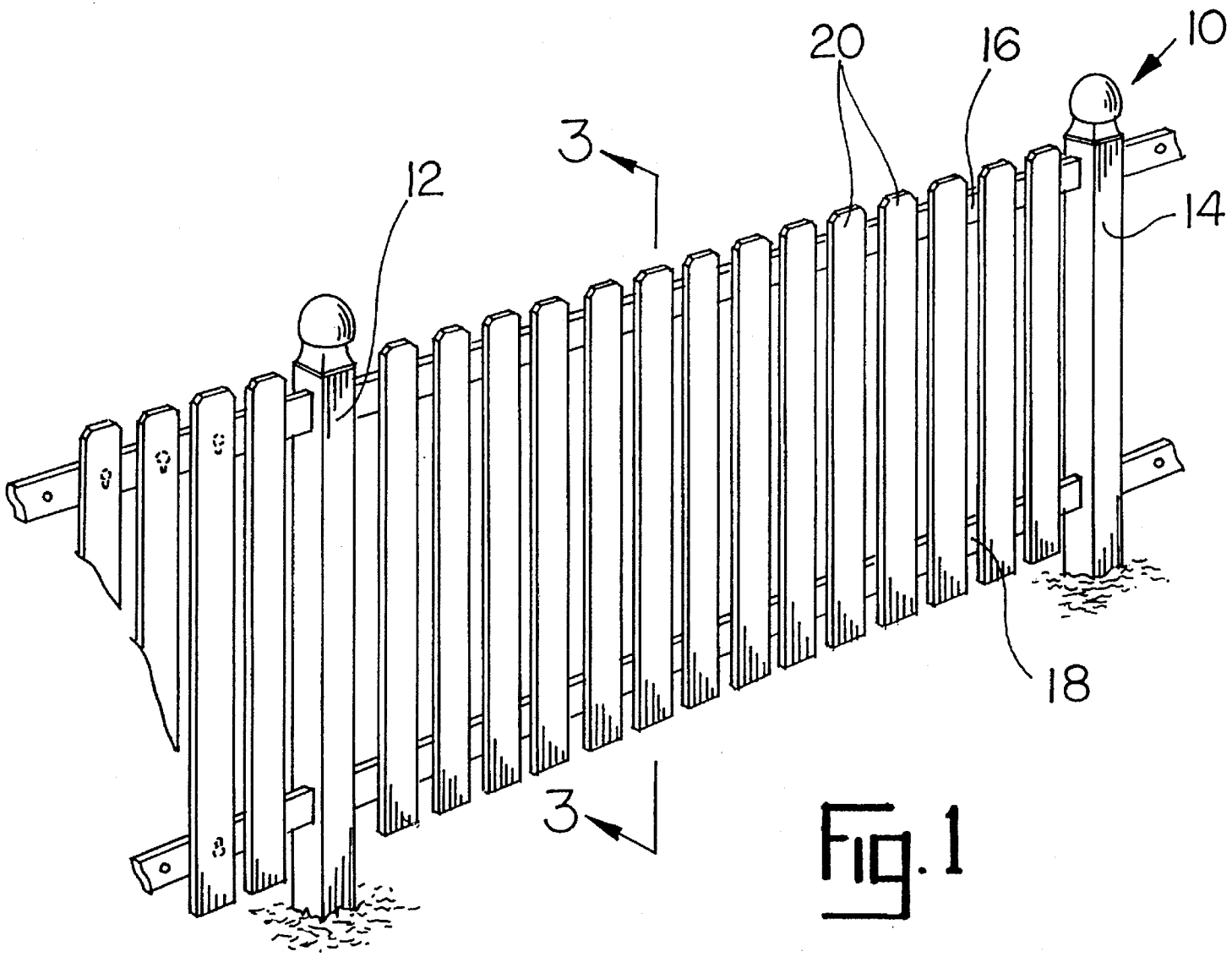
FIG. 1 is a perspective view of the polyvinyl picket fence made pursuant to the teachings of the present invention.
Figure 2:
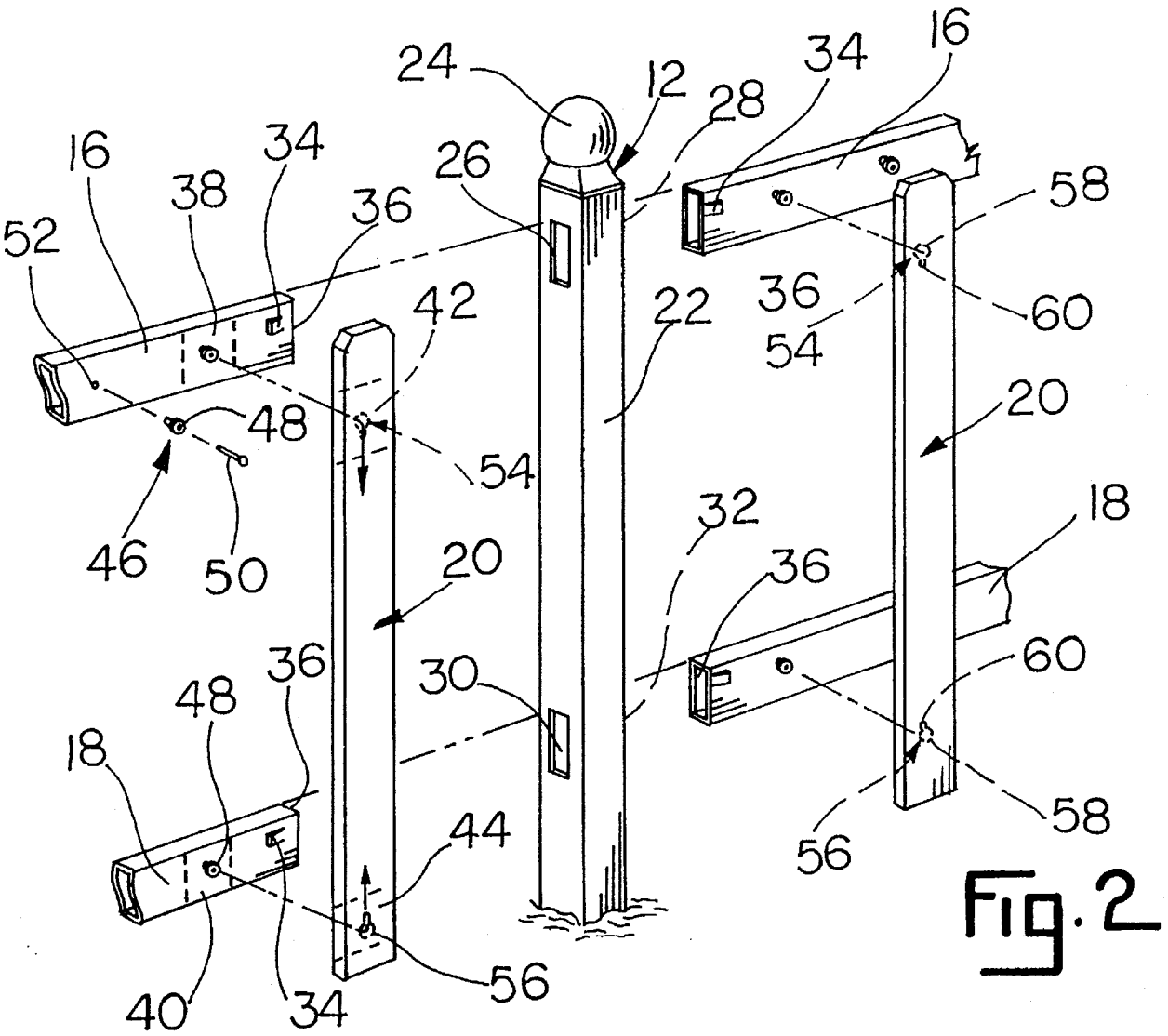
FIG. 2 is an exploded view in perspective of the picket fence illustrated in FIG. 1 showing the various components of the fence disassembled from each other.
Figure 3:
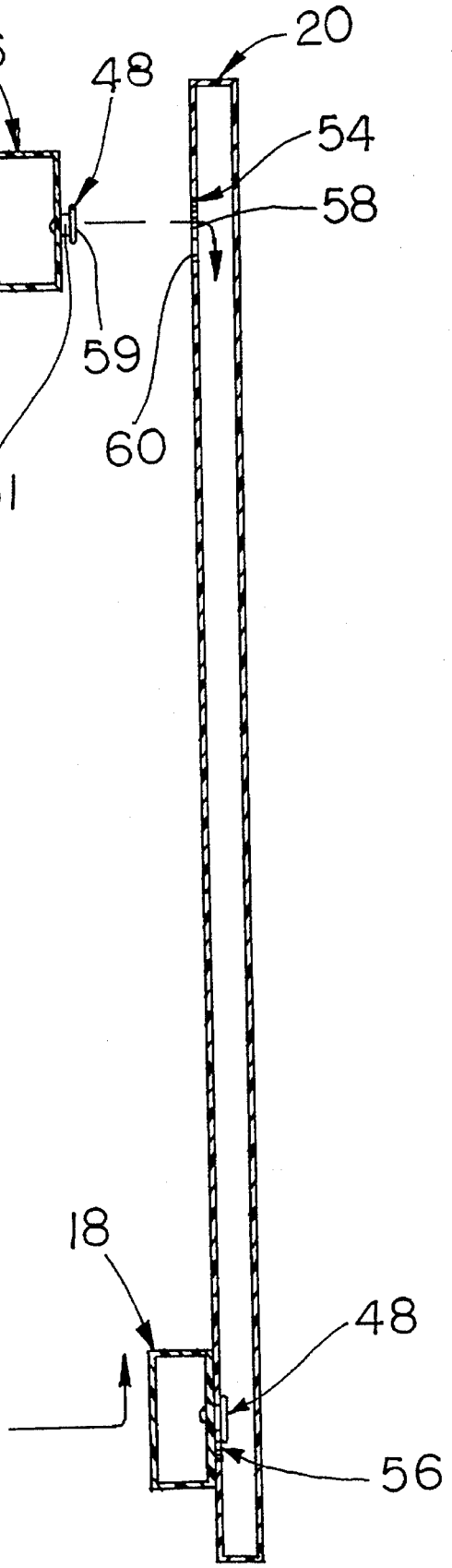
FIG. 3 is a view taken substantially along lines 3—3 of FIG. 1, but illustrating the upper rail thereof disassembled from the picket.
Figure 4:
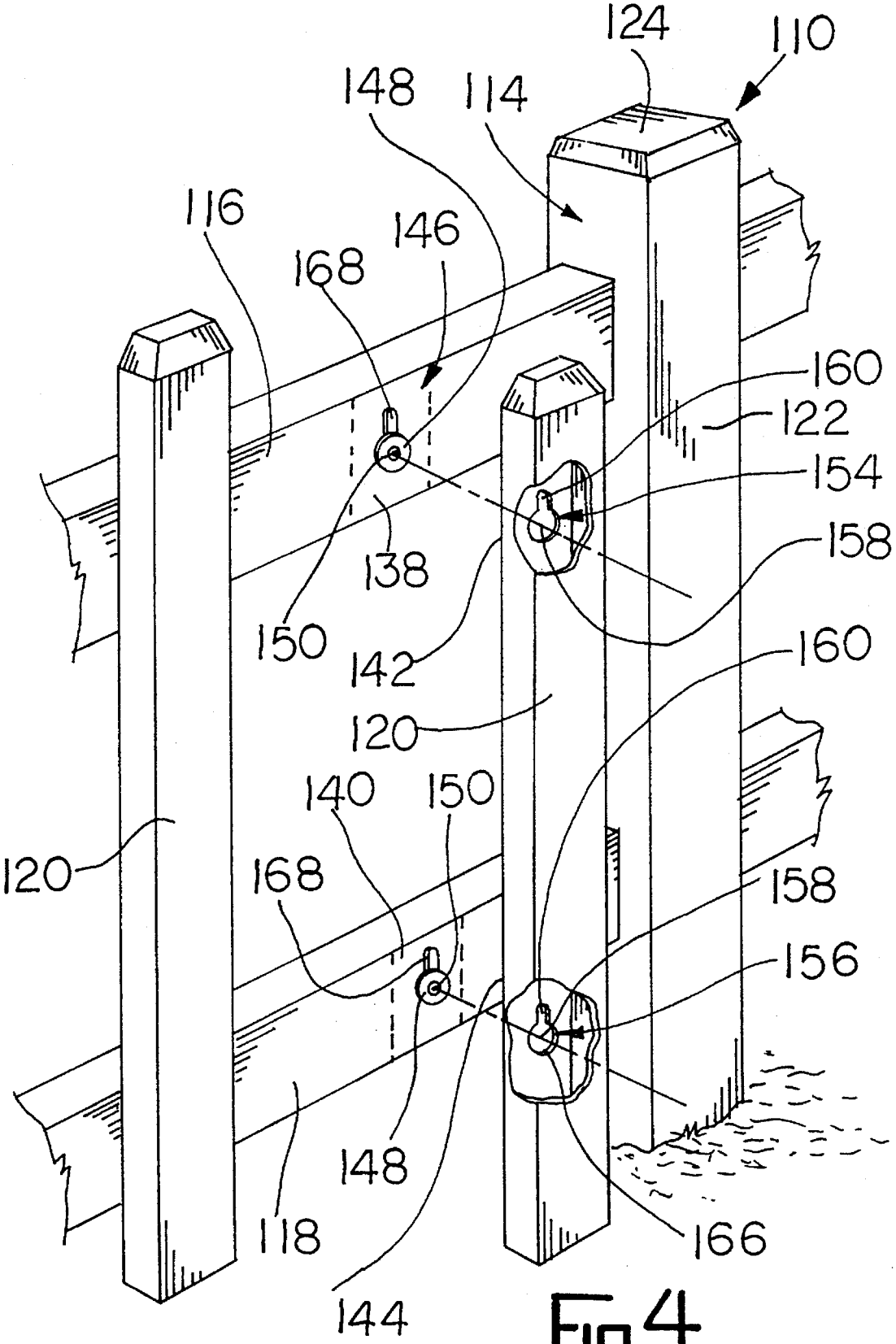
FIG. 4 is a fragmentary perspective view of an additional embodiment of the present invention.
Figure 5:
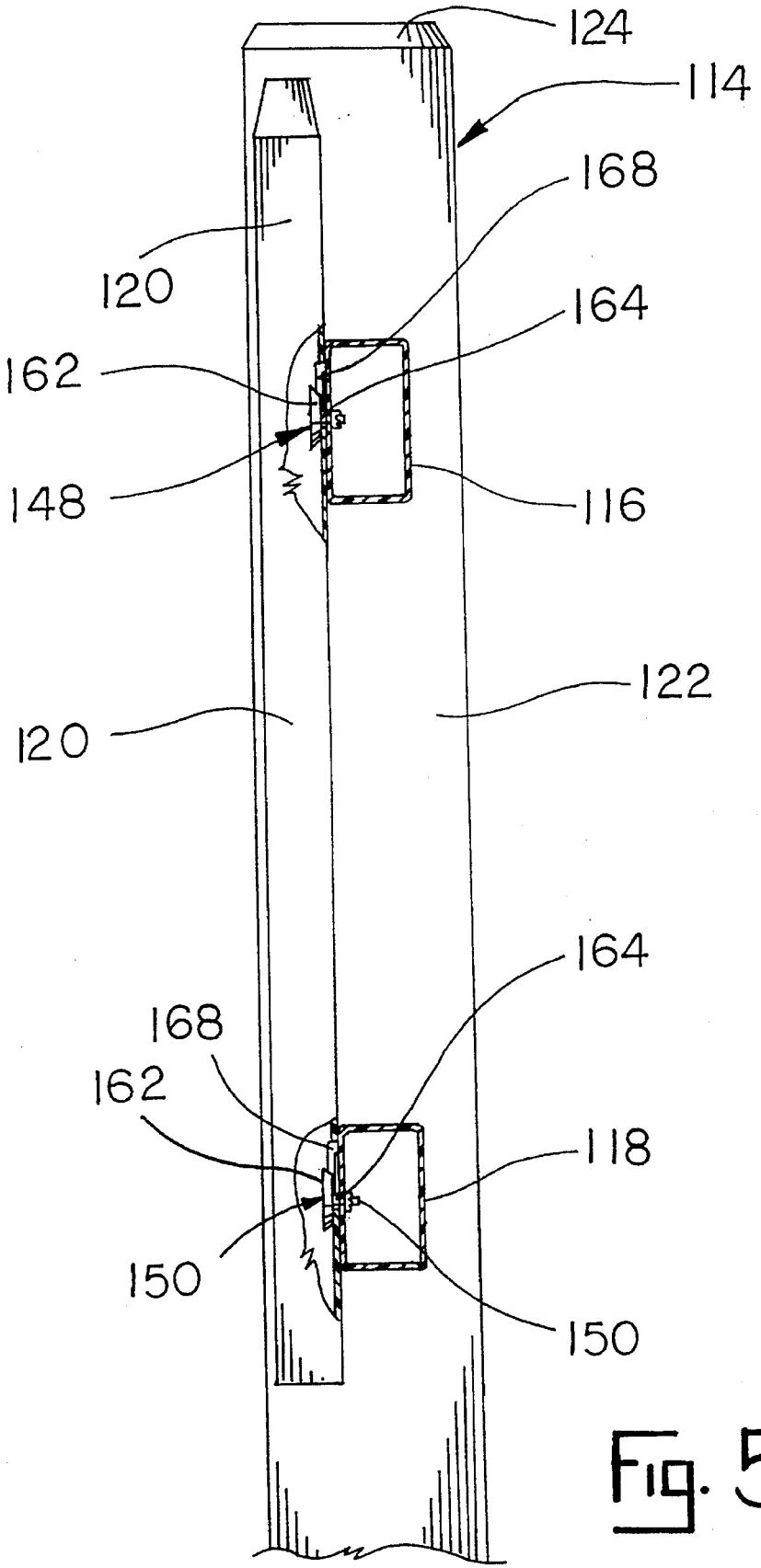
FIG. 5 is a side view of the picket fence illustrated in FIG. 4.
Figure 6:
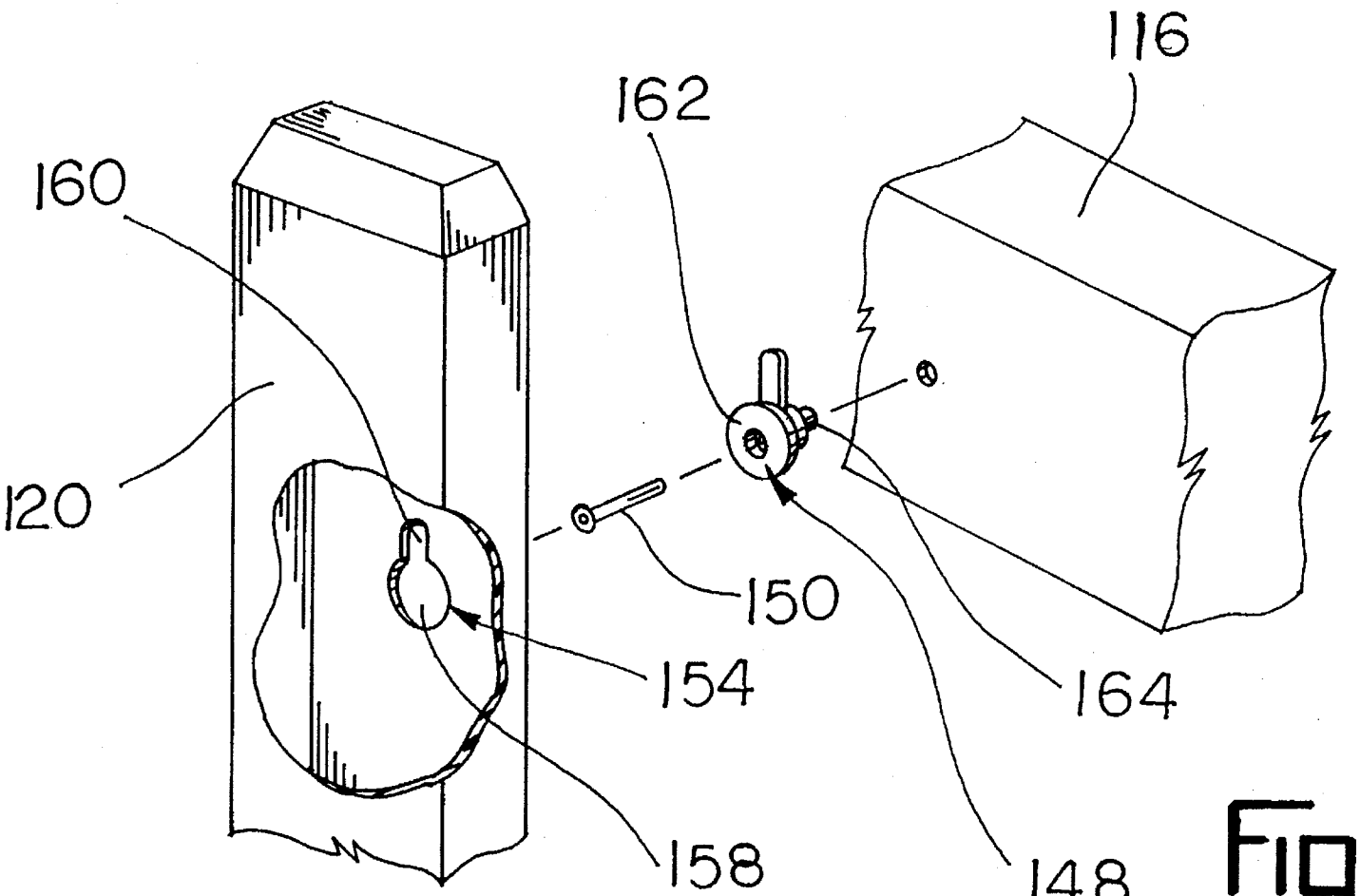
FIG. 6 is an exploded view showing the various components of the picket fence illustrated in FIG. 4.
Figure 8:
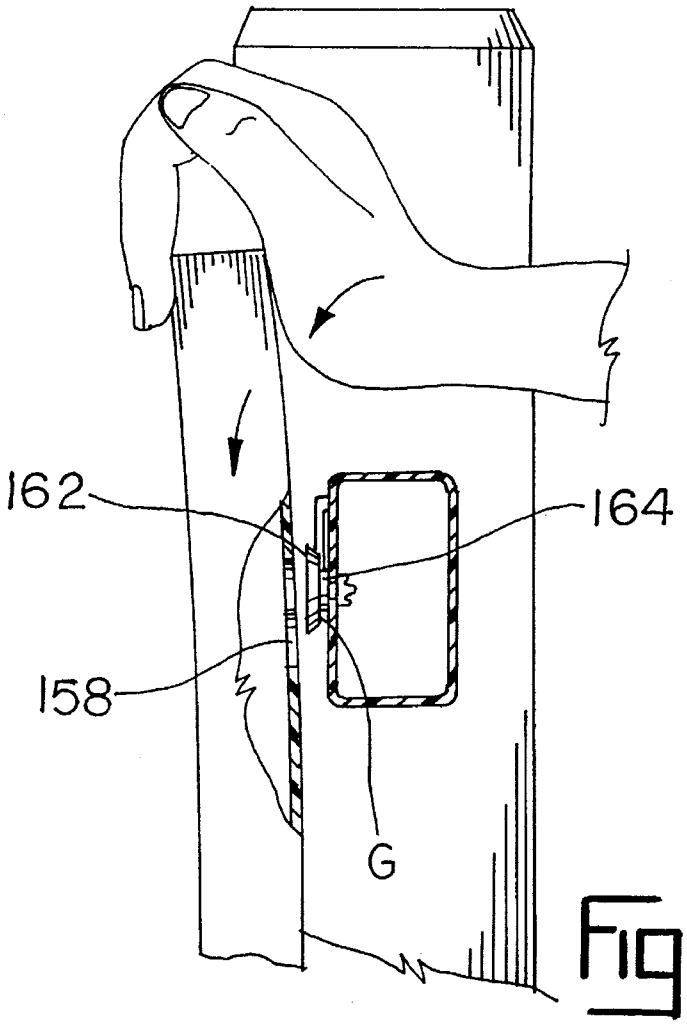
FIG. 8 illustrates another step for disconnecting the pickets from the rails.

Referring now to the embodiment of FIGS. 1–3, a picket fence generally indicated by the numeral 10 includes spaced posts 12, 14 which support a substantially horizontal top rail 16 and a substantially horizontal bottom rail 18. Multiple pickets 20 are supported by the top and bottom rails 16, 18 and are spaced substantially evenly between the posts 12 and 14 along the rails 16, 18. Each of the posts 12, 14 include a tubular portion 22 and a top cap 24. The tubular portion 22 includes upper apertures 26, 28 on opposite sides thereof, which are substantially rectangular and receive corresponding sections if the upper rail 16, which is also substantially rectangular in cross-section. Similarly, the tubular portion 22 is provided with bottom apertures 30, 32, which are also substantially rectangular and receive corresponding sections of the bottom rail 18. Each section of the top rail 16 and the bottom rail 18 is provided with an outwardly projecting deflectable clip 34. When the sections of the top rail 16 and the bottom rail 18 are installed on the post 24, the corresponding end 36 is inserted in the corresponding aperture 26–32, and then forced into the tubular portion 22 until the clip 34 engages the wall of the tubular portion 22 adjacent the aperture, thereby restraining withdrawal of the corresponding section of top rail 16 and bottom rail 18 from the post.

The top rail 16 and bottom rail 18 each include an engaging surface 38, 40 which engages the corresponding surface 42, 44 on pickets 26 when the latter are installed on the rails 16, 18. Pickets 20 are retained on the rails 16, 18 by releasable locking mechanisms generally indicated by the numeral 46. Each of the locking mechanisms 46 include a cleat 48 which is secured to the corresponding rail by a rivet 50 which extends through the cleat 48 and into a drilled hole 52 in the corresponding rail. Locking mechanisms 46 further include keyhole shaped slots 54, 56 adjacent the top and bottom each picket 20, which are adapted to engage their corresponding cleats 48 on the top and bottom rails 16, 18.

Each of the keyhole-shaped slots include a receiving portion 58 and a locking portion 60. Receiving portion 58 is large enough to receive the enlarged head 59 of the cleat 48 while the locking portion 60 embraces the smaller portion 61 of the cleat 48 between the head and the rail. It will be noted that the locking portion 60 associated with the slot 54 which engages the cleat secured to the upper rail 16 extends downwardly from the receiving portion 58, whereas the locking portion 60 associated with slot 56 which engages the cleat on the lower rail 18 extends upwardly from the receiving portion 58. As will hereafter be explained, it is important that the locking portions 60 of the upper and lower slots 54, 56 extend in opposite directions. While the locking portion 60 of the upper slot 54 is illustrated as facing downwardly and the locking portion 60 of the slot 56 is illustrated as facing upwardly, the orientations of the locking portions 60 of the slots 54 and 56 may be reversed, that is, the locking portion 60 of the slot 54 may extend upwardly and the locking portion 60 of the slot 56 may extend downwardly.

When the fence is assembled, each of the pickets 20 are placed across sections of the upper rail 16 and the lower rail 18 such that the corresponding cleats 48 are received within receiving portions 58 of the slots 54, 56. The upper rail 16 is then forced downwardly relative to the pickets 20, thereby forcing each of the cleats 38 on upper rail 16 into the locking portions 60 of the slots 54 on each picket 20. Similarly, the cleats 48 on lower rail 18 are received in the receiving portion 58 of the slots 56 of each picket 20, and the section of bottom rail 18 is then forced upwardly relatively to the pickets 20 such that each of the cleats 48 are embraced by the locking portion 60 of the slots 44. The end portions 36 of the upper and lower rail 16, 18 are then forced in the corresponding apertures 26–32 of the posts 22. Clip 34 will then engage the wall of the post 22 to maintain the ends of the rails 16, 18 within their corresponding apertures. Since the apertures are a fixed vertical distance apart, the rails 16 and 18 cannot be moved relative to each other up or down unless the rails are first removed from their corresponding posts. Since the rails 16, 18 cannot be moved relative to each other vertically, and since each of the cleats 48 on the corresponding rails are received with locking portion 60, it is impossible to move pickets 20 relative to the rails 16, 18 unless the rails 16, 18 are first removed from at least one of the posts 22. Accordingly, it is not possible for children playing around the fence 10 to remove the pickets 20 from the rails 16, 18. Furthermore, it will be noted that the cleats 48 and slots 54, 56 are all enclosed within the engaging portions 38, 42 and 40, 44 of the pickets 20 respectively. Accordingly, neither the cleats 48 nor the slots 54, 56 are visible. Furthermore, the clips 34 are wholly received within the posts 22, so that neither the clips 34, the cleats 48, or the slots 54, 56 will be visible when the fence is installed for normal use.

Figure 7:
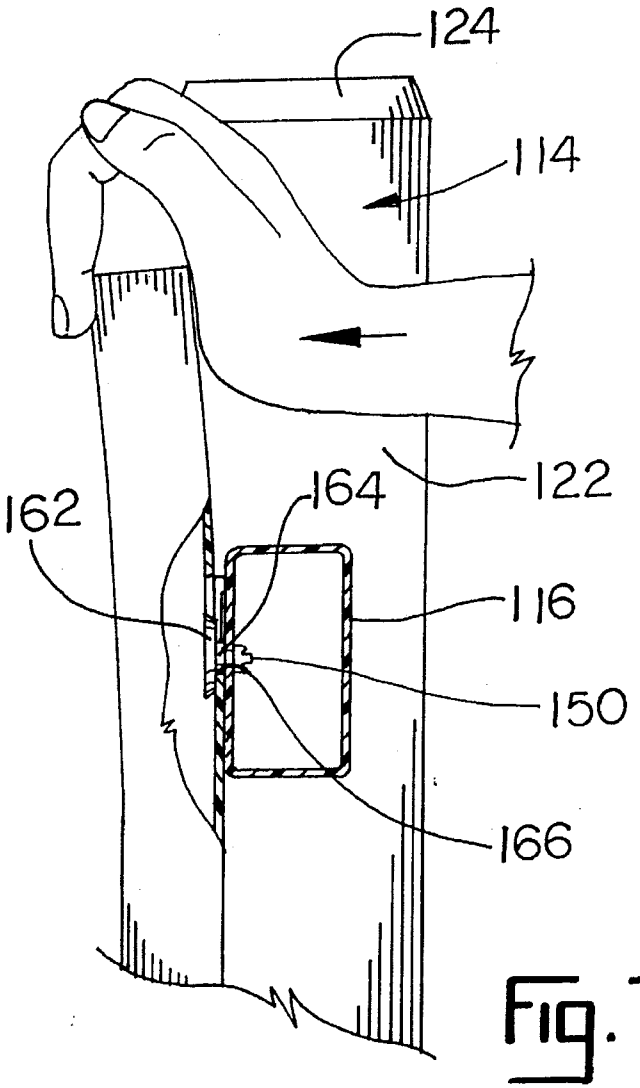
FIG. 7 illustrates a first step for disconnecting the pickets from the rails.

Referring now to the embodiment of FIGS. 4–8, elements the same or substantially the same as those in the preferred embodiment retain the same reference numeral, but increased by 100. In FIGS. 4–8, the narrower locking portions 160 of the slots 154, 156 extend in the same direction, that is, upwardly viewing FIGS. 4–8. The cleats 148 include a head 162 which projects from a stem 164 which is attached to the corresponding rail 116 or 118 by the rivet 150. The head 162 cooperates with the stem 164 and the portion 138 or 140 of the corresponding rail 116 or 118 to define a gap G therebetween. Accordingly, the head 162 is received within the receiving portion 158 of the corresponding slot 154 or 156, and the corresponding picket 120 is thereafter urged upwardly, to thereby engage a locking portion 166, which is defined on the edge of the corresponding slot opposite the narrow portion 160 thereof, in the gap G, to thereby retain the picket on the rails. At the same time, a locking arm 168, which extends from the stem 164 and projections from the gap G, snaps into the narrow portion 160 of the corresponding slots 156 or 158. Accordingly, the pickets are prevented from being removed from the rails by merely forcing the latter downwardly. In order to remove the pickets from the rails, the pickets, which are deflectable, must be deflected manually as shown in FIG. 7, to snap the narrow portion 160 of the slots away from the locking arms 168. Alter the slot is moved away from the arm, the rail can then be forced downwardly and removed. Since both the top and bottom of the rail must be deflected simultaneously, a screw driver or similar tool is inserted between the surfaces 140, 144 of the lower rail to thereby deflect the picket such that the narrow portion 160 of the slot 156 is deflected away from the corresponding locking arm 168. The top of the picket 120 can then be grasped as illustrated in 170 and forced away from the locking arm 168 on the cleat 150. Since both the top and bottom must be deflected simultaneously, it is extremely unlikely that the picket can be removed accidentally, thereby children playing around the fence. The height of the locking arms 168 is such that the head 148 can be easily received in the receiving portion 158 of the slots when the picket is reinstalled. The picket can then be moved upwardly, permitting the picket to snap over the arms 168 such that the latter are engaged with the corresponding portions 160 of their slots.

I claim:

1. Picket fence comprising a pair of substantially vertical posts, a top rail member and a bottom rail member supported by each of said posts and extending therebetween so that each of said top and bottom rail members is supported substantially horizontally by said posts, multiple picket members extending between said top and bottom rail members substantially parallel to said posts, and releasable locking means for securing each of said picket members to both said top and bottom rail members, said releasable locking means includes a cleat on one of said members and a recess in the other member, said recess having a locking portion, said cleat being received within the recess and then forced into the locking portion of the recess as the one member is moved relative to the other member.

2. Picket fence as claimed in claim 1, wherein each of said posts includes a tubular portion having top and bottom apertures, the top and bottom apertures on each post facing the corresponding aperture on the other post, said top rail member having opposite ends received in the top apertures of said posts, said bottom rail member having opposite ends received in the bottom apertures of said posts.

3. Picket fence as claimed in claim 2, wherein said posts and said rail members include cooperating retaining means for securing said rail members in said apertures.

4. Picket fence as claimed in claim 1, wherein said rail members and said picket member each include mutually engaging surfaces, said releasable locking means being located on said engaging surfaces whereby said releasable locking means is concealed by the picket member and the corresponding rail.

5. Picket fence as claimed in claim 1, wherein said rail members include a tubular portion and said picket members include tubular housing, each of said tubular portions and tubular housing including engaging surfaces, said releasable locking means being located entirely within said engaging surfaces to permit each said rail member and picket member to fully conceal the releasable locking means securing the picket member to the rail member.

6. Picket fence as claimed in claim 5, wherein the locking means on both the top rail member and the bottom rail member engage each picket member, the locking portion of the recess associated with one of said rail members being directed upwardly from, the locking portion of the recess associated with the other rail member being directed downwardly.

7. Picket fence as claimed in claim 1, wherein the releasable locking means includes a first locking set on said top rail member and on a picket member and a second locking set on said bottom rail member and on a picket member, each of said locking sets including a recess in one of said members receiving a cleat extending from the other member.

8. Picket fence as claimed in claim 7, wherein each said recess has an entry portion for receiving said cleat, said locking portion embracing said cleat upon relative movement of said rail members with respect to said picket members.

9. Picket fence as claimed in claim 8, wherein the locking portion of one of said recesses extends upwardly from said entry portion and the locking portion of the other recess extends downwardly from said entry portion.

10. Picket fence as claimed in claim 9, wherein said recesses are keyhole slots having a larger width portion and a smaller width portion, said larger width portion defining said entry portion and the smaller width portion defining said locking portion.

11. Picket fence as claimed in claim 9, wherein each of said posts includes a tubular portion having top and bottom apertures, the top and bottom apertures on each post facing the corresponding aperture on the other post, said top rail member having opposite ends received in the top apertures of said posts, said bottom rail member having opposite ends received in the bottom apertures of said posts.

12. Picket fence as claimed in claim 11, wherein posts and said rail members include cooperating retaining means for securing said rail members in said apertures.

13. Picket fence as claimed in claim 11, wherein said rail members and said picket member each include mutually engaging surfaces, said releasable locking means being located on said engaging surfaces whereby said releasable locking means is concealed by the picket member and the corresponding rail.

14. Picket fence as claimed in claim 1, wherein said recess is defined by an edge, and said locking portion is a locking section of said edge of said recess.

15. Picket fence as claimed in claim 14, wherein said cleat includes a stem secured to said one member and a head projecting from said stem, said head cooperating with the stem and the one member to define a gap therebetween, said locking section of the recess being received within said gap to lock the one member on the other member.

16. Picket fence as claimed in claim 15, wherein a locking arm extends from said head and engages a section of said edge other than the locking section.

17. Picket fence as claimed in claim 15, wherein said recess is a keyhole slot having a larger width portion and a smaller width portion, said larger width portion receiving said cleat, said locking section being defined on said larger width portion, and a locking arm extending from said head into said smaller width portion.

18. Picket fence as claimed in claim 17, wherein a pair of cleats and recesses secure the other member to the one member, the smaller width portion of the recesses extend in the same direction from their corresponding larger width portions.

* * * * *